US009714146B2

(12) United States Patent
Ishida et al.

(10) Patent No.: US 9,714,146 B2
(45) Date of Patent: Jul. 25, 2017

(54) SHEET STORAGE APPARATUS AND IMAGE FORMING APPARATUS

(71) Applicant: CANON KABUSHIKI KAISHA, Tokyo (JP)

(72) Inventors: Toshiki Ishida, Kashiwa (JP); Yusuke Obuchi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/989,978

(22) Filed: Jan. 7, 2016

(65) Prior Publication Data

US 2016/0200531 A1 Jul. 14, 2016

(30) Foreign Application Priority Data

Jan. 8, 2015 (JP) ..... 2015-002108
Dec. 8, 2015 (JP) ..... 2015-239301

(51) Int. Cl.
*B65H 1/00* (2006.01)
*B65H 1/04* (2006.01)
*B65H 1/26* (2006.01)

(52) U.S. Cl.
CPC ..... *B65H 1/04* (2013.01); *B65H 1/266* (2013.01); *B65H 2405/112* (2013.01);
(Continued)

(58) Field of Classification Search
CPC ... B65H 1/04; B65H 1/08; B65H 1/12; B65H 1/14; B65H 2405/00; B65H 2405/1116; B65H 2405/112; B65H 2405/1122; B65H 2405/114; B65H 2405/11425; B65H 2405/1144; B65H 2511/11; B65H 2405/12
(Continued)

(56) References Cited

U.S. PATENT DOCUMENTS 5,632,477 A * 5/1997 Morinaga ..... B65H 1/08 271/127
6,409,165 B1 * 6/2002 Yamaoka ..... B65H 1/12 271/127
(Continued)

FOREIGN PATENT DOCUMENTS

JP 11-59925 A 3/1993
JP 08-034527 A 2/1996
JP 2002-362757 A 12/2002

*Primary Examiner* — Prasad Gokhale
(74) *Attorney, Agent, or Firm* — Fitzpatrick, Cella, Harper & Scinto

(57) ABSTRACT

A sheet storage apparatus includes a storage apparatus body, a sheet stacking portion, a rear end regulation member, and a rear end regulation attachment. The sheet stacking portion has an opening opened in an upward and downward direction, and is movable upward and downward with respect to a bottom portion of the storage apparatus body. The rear end regulation attachment is detachably attached to the rear end regulation member, which regulates an upstream end position in the sheet feed direction of the sheet stacked on the sheet stacking portion. The rear end regulation attachment includes a regulating portion that extends toward the bottom portion through the opening. The rear end regulation attachment regulates the upstream end of the sheet on a position downstream, in the sheet feed direction, of a regulating position of the rear end regulation member.

16 Claims, 10 Drawing Sheets

(52) U.S. Cl.
CPC ..... *B65H 2405/1116* (2013.01); *B65H 2405/1122* (2013.01); *B65H 2405/1144* (2013.01); *B65H 2405/11425* (2013.01); *B65H 2405/121* (2013.01); *B65H 2511/11* (2013.01); *B65H 2511/12* (2013.01); *B65H 2511/20* (2013.01); *B65H 2511/22* (2013.01); *B65H 2701/1916* (2013.01)

(58) Field of Classification Search
USPC ..... 271/171, 223
See application file for complete search history.

(56) References Cited

U.S. PATENT DOCUMENTS

| | | | | |
|---|---|---|---|---|
| 6,826,374 | B2 | 11/2004 | Kato et al. | |
| 6,904,261 | B2 | 6/2005 | Fujii et al. | |
| 6,997,449 | B2 | 2/2006 | Obuchi et al. | |
| 8,550,461 | B2 | 10/2013 | Sekigawa et al. | |
| 8,960,668 | B2 | 2/2015 | Obuchi | |
| 9,260,262 | B2 * | 2/2016 | Matsumoto | B65H 1/266 |
| 2004/0135306 | A1 * | 7/2004 | Takahashi | B65H 1/04 271/145 |
| 2009/0295073 | A1 * | 12/2009 | Furusawa | B65H 1/266 271/171 |
| 2010/0221051 | A1 * | 9/2010 | Yamazaki | B65H 1/04 399/400 |
| 2015/0097330 | A1 * | 4/2015 | Sato et al. | B65H 1/14 271/160 |
| 2015/0115521 | A1 | 4/2015 | Ishida et al. | |
| 2015/0203311 | A1 * | 7/2015 | Matsumoto | B65H 1/266 271/241 |

* cited by examiner

SHEET STORAGE APPARATUS AND IMAGE FORMING APPARATUS

BACKGROUND OF THE INVENTION

Field of the Invention

The present invention relates to a sheet storage apparatus for storing sheets, and an image forming apparatus including the sheet storage apparatus.

Description of the Related Art

Recently, image forming apparatuses, such as copiers, printers and facsimile machines, having a sheet feeding apparatus are widely used. Such an image forming apparatus feed a sheet with the sheet feeding apparatus to an image forming portion where an image is formed on the sheet. A typical sheet feeding apparatus includes a sheet feed cassette (sheet storage apparatus) that is drawably attached to the apparatus body and stores sheets to be fed to the image forming portion automatically. Some sheet feed cassettes include a sheet stacking portion on which sheets are stacked, and which is arranged to be lifted so that the sheets stacked thereon comes into contact with a sheet feed roller.

The sheet feed cassette having the sheet stacking portion includes a rear end regulation member. The rear end regulation member regulates a position of an upstream end (hereinafter referred to as a rear end), in a sheet feed direction, of the sheet stacked on the sheet stacking portion so as to allow a variety of sheets different in size to be stored in the cassette. Further, the sheet feed cassette is provided with a pair of side end regulation members that regulate a side end position in a direction orthogonal to the sheet feed direction (hereinafter referred to as a width direction).

The pair of side end regulation members of the sheet feed cassette regulates both side ends of the sheets while the rear end regulation member regulates the rear end of the sheets, so that the sheets are always positioned at the predetermined position. Thereby, sheets can always be fed from the same position on the sheet feed cassette stored in the apparatus body, and a stable sheet feeding performance can be achieved.

Meanwhile, there are increasing demands for realizing a large amount of printing on small-sized sheets such as postcards and envelopes. Conventionally, the small-sized sheets such as postcards and envelopes had to be fed through a manual sheet feed portion. Unfortunately, since the amount of sheets that can be stacked in the manual sheet feed portion was restricted to approximately 10 mm height, it was not suitable to perform printing on a large amount of sheets. In order to improve capability of massive printing, a sheet feed cassette allowing small-sized sheets to be stacked on is desirable, so that a large amount of the small-sized sheets are fed from the cassette. But generally, the minimum sheet size (A5 size, for example) that can be regulated using side end regulation members and rear end regulation member is larger than the small-sized sheets. Therefore, this kind of sheet feed cassette could not appropriately regulate the ends of the small-sized sheets smaller than the normally-used minimum sheet size (such as postcards and envelopes) with the side end regulation members and the rear end regulation member.

Here, Japanese Patent Application Laid-Open Publication No. 11-59925 discloses a sheet feed cassette having an auxiliary cassette (second cassette) capable of storing small-sized sheets and being attached to an inner side of a cassette body (first cassette). The second cassette includes a rear end regulation member and side end regulation members disposed at positions corresponding to ends of a sheet among small-sized sheets such as postcards and envelopes. This second cassette is attached to a sheet stacking portion of the first cassette, which is attached drawably to the apparatus body. This configuration enables the sheet feed cassette to regulate the ends of the small-sized sheet to be fed therefrom.

However, the side end regulation members and the rear end regulation member disclosed in the above document are fixed on the predetermined positions. Therefore, in order to feed multiple kinds of small-sized sheets different in size, it is necessary to prepare various types of second cassettes different in positions of side end regulation members and/or rear end regulation member positions. This configuration necessitates various types of second cassettes, which leads to increase in cost. Furthermore, users might feel inconvenient under this configuration because of time and labor required to select and replace the second cassettes manually each time the size of a small-size sheet in use is changed.

SUMMARY OF THE INVENTION

According to one aspect of the present invention, a sheet storage apparatus includes a storage apparatus body, a sheet stacking portion, a rear end regulation member, and a rear end regulation attachment. The sheet stacking portion has an opening opened in an upward and downward direction, and can move upward and downward with respect to a bottom portion of the storage apparatus body. The rear end regulation member is supported movably on the bottom portion of the storage apparatus body in a sheet feed direction and a direction opposite to the sheet feed direction, and regulates an upstream end position, in the sheet feed direction, of the sheet stacked on the sheet stacking portion. The rear end regulation attachment is detachably attached to the rear end regulation member. The rear end regulation attachment includes a regulating portion extending toward the bottom portion of the storage apparatus body through the opening in a state where the rear end regulation attachment is attached to the rear end regulation member. The regulating portion regulates the upstream end of the sheet on a position downstream, in the sheet feed direction, of a regulating position of the rear end regulation member.

According to another aspect of the present invention, a sheet storage apparatus includes a storage apparatus body, a sheet stacking portion, a side end regulation member, a rear end regulation member, and a rear end regulation attachment. The sheet stacking portion can move upward and downward with respect to a bottom portion of the storage apparatus body. The side end regulation member is supported movably on the bottom portion in a width direction orthogonal to a sheet feed direction, and abuts against an end portion in the width direction of the sheet stacked on the sheet stacking portion. The rear end regulation member is supported movably on the bottom portion in a sheet feed direction and a direction opposite to the sheet feed direction, and includes a main regulating surface abutting against an upstream end, in the sheet feed direction, of the sheet stacked on the sheet stacking portion. The sheet stacking portion includes a side end cutout portion for allowing movement of the side end regulation member and a rear end cutout portion for allowing movement of the rear end regulation member. The rear end regulation attachment is attached in a detachable manner to the rear end regulation member, and includes a subsidiary regulating surface to regulate the upstream end of the sheet. The subsidiary regulating surface is arranged downstream in the sheet feed direction of the main regulating surface of the rear end regulation member and. The rear end regulation attachment is attached to the rear end regulation member in a condition in which The rear end regulation attachment slidably contact with the bottom portion of the storage apparatus body through the side end cutout portion.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
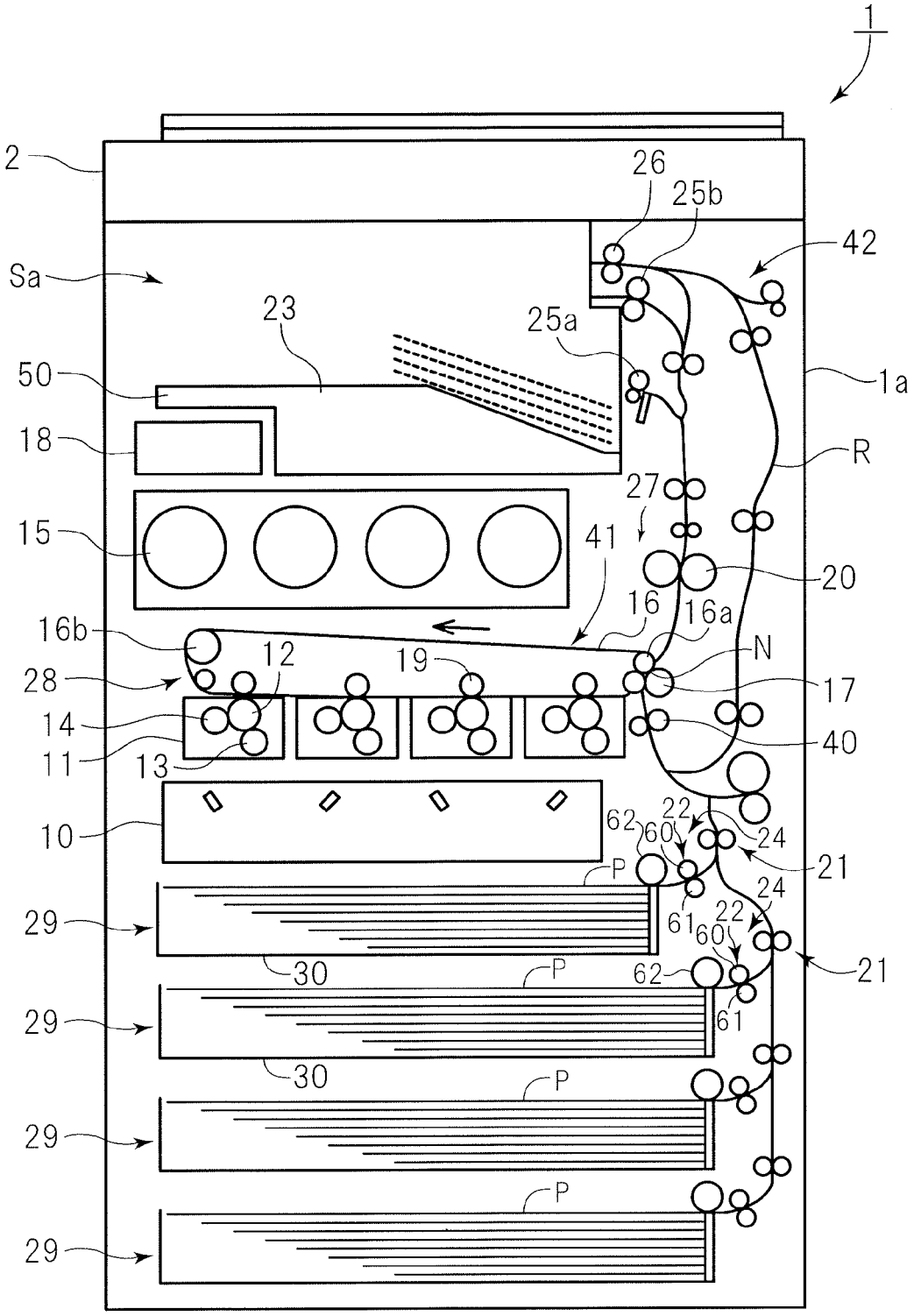
FIG. 1 is a schematic cross-sectional view illustrating an image forming apparatus having a sheet feed cassette according to the present embodiment.

Now, an embodiment of the present invention will be described in detail with reference to the drawings. At first, an image forming apparatus having a sheet feed cassette, i.e., a sheet storage apparatus, will be described with reference to FIG. 1. FIG. 1 is a schematic cross-sectional view illustrating a laser beam printer, i.e., an image forming apparatus according to the present embodiment, viewed from a front side.

Image Forming Apparatus

As illustrated in FIG. 1, a full-color laser beam printer (hereinafter referred to as "printer") 1 as an image forming apparatus includes an image forming apparatus body (hereinafter referred to as apparatus body) 1*a*. The apparatus body 1*a* includes an image forming portion 28, a fixing portion 20, and an image reading unit 2. The image reading unit 2 is an upper unit arranged substantially horizontally and above the apparatus body 1*a*. The apparatus body 1*a* includes a controller 18 for controlling each part of the apparatus.

A discharge space Sa for discharging sheets is formed between the image reading unit 2 and the apparatus body 1*a*. A toner cartridge 15 is arranged below the discharge space Sa, and a plurality of (four, in the present embodiment) sheet feeding apparatuses 29 are arranged at a lower portion of the apparatus body 1*a*.

The image forming portion 28 adopts a four-drum full-color system, and includes a laser scanner 10, and four process cartridges 11 for forming toner images of four colors, which are yellow (Y), magenta (M), cyan (C) and black (K).

Each process cartridge 11 include a photosensitive drum 12, i.e., a photosensitive body, a charging unit 13, i.e., a charging means, a developer 14, i.e., a developing means, and a cleaner (not shown), i.e., a cleaning means. Further, the image forming portion 28 includes an intermediate transfer unit 41 arranged above the process cartridges 11.

The intermediate transfer unit 41 includes an intermediate transfer belt 16, i.e., an image bearing member wound around a drive roller 16*a*, and a tension roller 16*b*. Further, the intermediate transfer unit 41 includes primary transfer rollers 19 arranged on an inner side of the intermediate transfer belt 16 and abutted against an inner side surface of the intermediate transfer belt 16 at positions opposing to the respective photosensitive drums 12. The intermediate transfer belt 16 is composed of a film-like member, and abutted against the respective photosensitive drums 12. The drive roller 16*a* that is driven by a drive unit not shown drivingly rotates the intermediate transfer belt 16 in an arrow direction.

On the intermediate transfer belt 16 is applied transfer bias having positive polarity by the primary transfer roller 19. Then, toner images of respective colors, which have negative polarity, are transferred to the photosensitive drums 12 under the transfer bias. These toner images are sequentially transferred to the intermediate transfer belt 16 in multiple layers. Thereby, a color image is formed on the intermediate transfer belt. At the position opposing to the drive roller 16*a* of the intermediate transfer unit 41 is arranged a secondary transfer roller 17 for transferring the color image formed on the intermediate transfer belt onto a sheet P. The drive roller 16*a* and the secondary transfer roller 17 pressed against the drive roller 16*a* constitute a secondary transfer nip N, i.e., a secondary transfer portion.

The fixing portion 20 is arranged downstream in a sheet conveyance direction from the secondary transfer roller 17. Above the fixing portion 20 are arranged a first discharge roller pair 25*a*, a second discharge roller pair 25*b*, and a surface reversing portion 42, i.e., a reverse discharge portion. The surface reversing portion 42 includes an inverting roller pair 26, i.e., a sheet reverse conveyance roller capable of bidirectional rotation, and a re-conveyance path R. The re-conveyance path R conveys the sheet that is formed an image on a first surface thereof to the image forming portion 28 again. The image forming portion 28, the secondary transfer nip N and the fixing portion 20 constitute an image forming unit 27 for forming images on a sheet P fed from the sheet feeding apparatus 29, which will be described in detail later. The image forming unit 27 forms an image on the sheet P sent from a sheet feed cassette 30.

With the configuration as described above, an image information read by the image reading unit 2 or entered from an external device such as a personal computer (PC) not shown is subjected to image processing, converted to electrical signals, and transmitted to the laser scanner 10 of the image forming portion 28.

In the image forming portion 28, the surfaces of the photosensitive drums 12 in the respective process cartridges 11 are scanned by laser beams emitted from the laser scanner 10, based on the image information of the respective color components of yellow, magenta, cyan and black. Thereby, the surfaces of the photosensitive drums 12 in the process cartridges 11 are charged evenly to predetermined polarity and potential by the charging units 13, exposed by the laser scanner 10, and formed with electrostatic latent images that correspond to respective single-colored images of yellow, magenta, cyan and black.

Thereafter, the electrostatic latent images are developed by the respective colored toners of yellow, magenta, cyan and black to be visualized. The colored toner images developed on the respective photosensitive drums are sequentially transferred and superposed on a preceding colored toner image, to the intermediate transfer belt 16 under primary transfer bias applied to the primary transfer roller 19. Thereby, a toner image is formed on the intermediate transfer belt 16.

Meanwhile, the sheet P sent from the sheet feeding apparatuses 29 passes a registration roller pair 40, and is transferred to the secondary transfer nip N. The registration roller pair 40 abut against the front end (downstream end) of the sheet P. With this configuration, a loop in sheet P is formed while the front end of the sheet P follows the nip portion, and skewing of the sheet P is corrected thereby. At the secondary transfer nip N, the toner images formed on the image forming portion 28 are collectively transferred (secondary-transferred) onto the sheet P.

Thereafter, the sheet P with the secondary-transferred toner image is conveyed to the fixing portion 20. The fixing portion 20 applies heat and pressure on the sheet P so that the toner image is fixed to the sheet as color image. The sheet P with a fixed color image is discharged by the first discharge roller pair 25*a* to the discharge space Sa, and stacked on a stacking portion 23 of the discharge space Sa.

Sheet Feeding Apparatus

Each sheet feeding apparatus 29 includes the sheet feed cassette 30 as an example of a sheet storage apparatus for storing the sheets P, and a sheet conveyance portion 24 for conveying the sheet P stored in the sheet feed cassette 30 toward a drawing roller pair 21 disposed downstream. The sheet conveyance portion 24 is arranged above and downstream in a sheet feed direction from the sheet feed cassette 30. The sheet conveyance portion 24 includes a pickup roller 62 and a separating roller pair 22 of a feed roller 60 and a retard roller 61. The pickup roller 62, i.e., a sheet feeding member, is supported pivotably in an upward and downward direction via a pivotable arm (not shown) around the feed roller 60. Being pressed against the sheet P stored in the sheet feed cassette 30, the pickup roller 62 rotates to send out the sheet P.

When image forming operation is started, the sheets P are separated and fed one by one from the sheet feed cassette 30 through the sheet conveyance portion 24. The pickup roller 62 is arranged above a sheet stacking portion 32 described later (refer to FIG. 2A). Thus, when the sheet stacking portion 32 is lifted, the pickup roller 62 abuts against an uppermost sheet of the sheets P stacked on the sheet stacking portion 32, and conveys the sheet toward the sheet feed direction (right side of FIG. 1). The sheet P sent out by the pickup roller 62 is conveyed by the feed roller 60, while the sheets other than the uppermost sheet among overlapped sheets is returned by the retard roller 61 toward the sheet feed cassette 30.

The sheet P separated and conveyed by the separating roller pair 22 composed of the feed roller 60 and the retard roller 61 is sent further downstream by the drawing roller pair 21, and conveyed to the registration roller pair 40. Thereafter, as described above, image is formed on the sheet P, and the sheet is discharged.

Detailed Configuration of the Sheet Feed Cassette

Figure 2A:
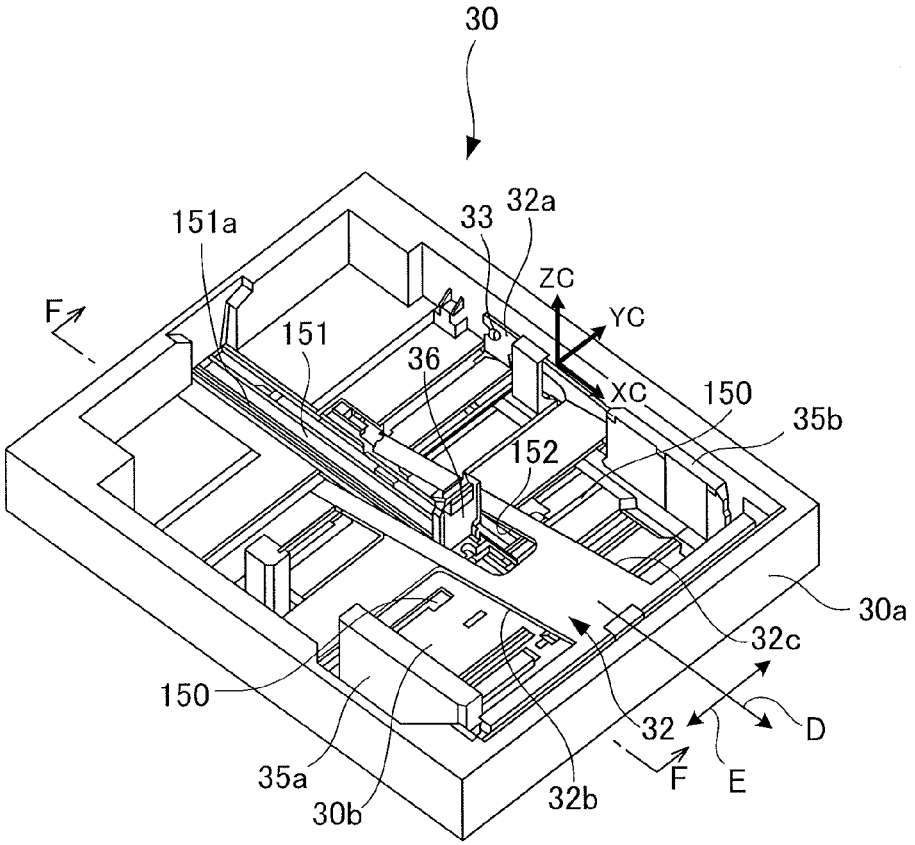
FIG. 2A is a perspective view of a sheet feed cassette according to the present embodiment.
Figure 2B:
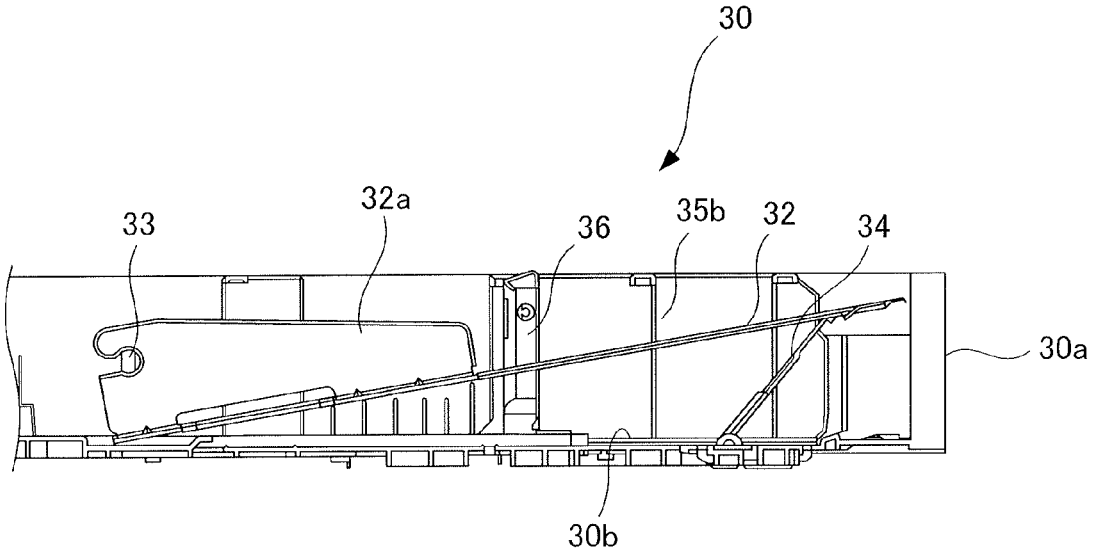
FIG. 2B is a cross-sectional view of the sheet feed cassette according to the present embodiment, taken along the line F-F in FIG. 2A and viewed in the arrow direction.
Figure 3:
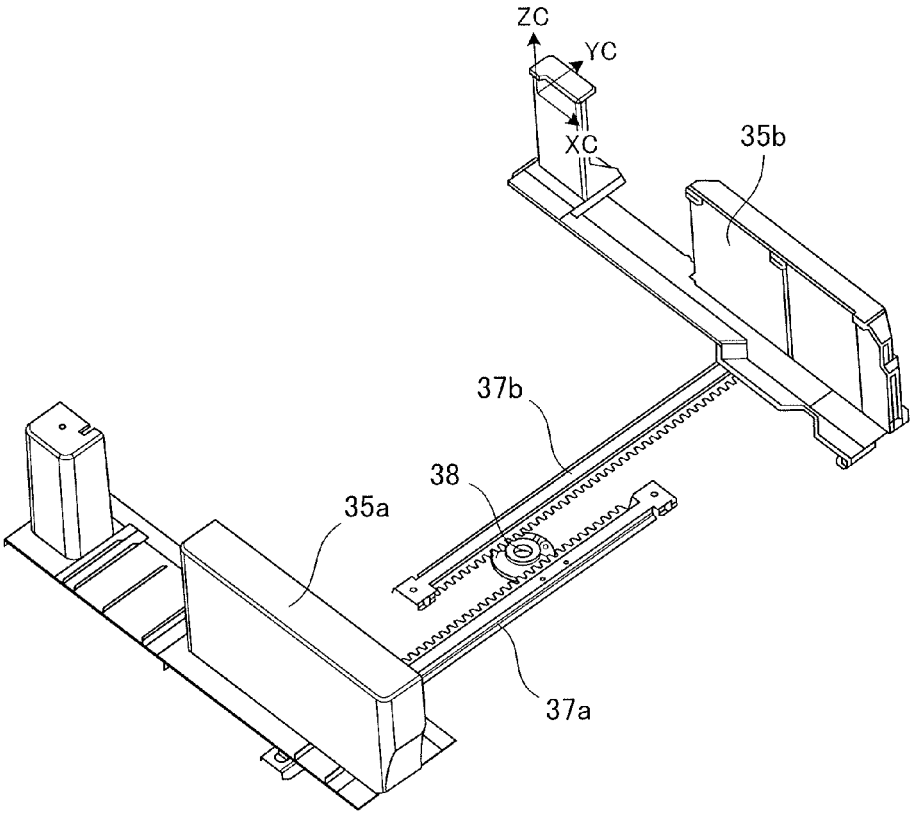
FIG. 3 is a perspective view illustrating a configuration for relative displacement of side end regulation members.

Next, with reference to FIGS. 2A, 2B and 3, a detailed configuration of the sheet feed cassette 30 according to the present embodiment will be described. FIG. 2A is a perspective view of the sheet feed cassette 30, and FIG. 2B is a cross-sectional view of the sheet feed cassette 30 taken along the line F-F in FIG. 2A and viewed in an arrow direction. Further, FIG. 3 is a perspective view illustrating a configuration for relative displacement of a pair of side end regulation members 35*a* and 35*b*.

As illustrated in FIGS. 2A and 2B, the sheet feed cassette 30 includes a cassette body 30*a* mounted to a front side of the apparatus body 1*a* in a drawable manner. The sheet feed cassette 30 is an example of a sheet storage apparatus, and the cassette body 30*a* is an example of a storage apparatus body. Within the cassette body 30*a* is disposed a support shaft 33 protruding from an inner side wall of the cassette body 30*a*. The support shaft 33 supports a pivot support portion 32*a* disposed on a plate-like sheet stacking portion 32 (intermediate plate). With this arrangement, the sheet stacking portion 32 with the sheet P on is supported pivotably, in the upward and downward direction (a vertical direction) with respect to a bottom portion 30*b* of the cassette body 30*a*, around the support shaft 33 as a fulcrum.

Further, a lifter arm 34 for lifting the sheet stacking portion 32 is supported pivotably on the bottom portion 30*b* within the cassette body 30*a*. When the controller 18 (refer to FIG. 1) drive a motor (not shown), the lifter arm 34 that is transmitted drive force from the motor pivots and pushes up the sheet stacking portion 32. Then, based on the detection of a sheet surface detection sensor (not shown), the sheet stacking portion 32 stops pivoting when an upper surface of an uppermost sheet among the sheets stacked on the sheet stacking portion 32 is positioned at a predetermined feeding position.

A pair of side end regulation members 35*a* and 35*b* regulating end point positions in a width direction of the sheet are arranged in the cassette body 30*a*. As illustrated in FIGS. 2A and 2B, a rear end regulation member 36 for regulating a rear end of the sheet is arranged in the cassette body 30*a*. As illustrated in FIG. 3, the side end regulation members 35*a* and 35*b* are coupled with rack gears 37*a* and 37*b* and a pinion gear 38 positioned between the rack gears and engaged with both gears. This configuration enables the side end regulation members 35*a* and 35*b* to be relatively displaceable, that is, capable of moving closer to or away from each other.

As illustrated in FIGS. 2A and 2B, side end regulation members 35*a* and 35*b* and the rear end regulation member 36 are disposed in the sheet feed cassette 30. Each member among the side end regulation members 35*a* and 35*b* and the rear end regulation member 36 is slidable with respect to the bottom portion 30*b* of the cassette body 30*a*. The side end regulation members 35*a* and 35*b* slide closer to or away from each other along groove-like guide portions 150. The guide portions 150 are formed as a long cutout in a width direction (direction of arrow E) orthogonal to a sheet feed direction (direction of arrow D) on the bottom portion 30*b*. That is to say, the side end regulation members 35*a* and 35*b* being movable relatively in the width direction (direction of arrow E) are configured to abut against side end of the sheets stacked on the sheet stacking portion 32 and regulate the position of the sheets. Here, an arrow XC denotes a direction parallel to the sheet feed direction (direction of arrow D), an arrow YC denotes a direction parallel to the width direction (direction of arrow E), and an arrow ZC denotes a vertical direction orthogonal to XC and YC.

The sheet stacking portion 32 includes side end cutout portions 32*b* and 32*c* formed on side portions thereof. The side end cutout portions 32*b* and 32*c* are configured to allow movement of the respective side end regulation members 35*a* and 35*b* in the width direction, that is, to form a space in which the side end regulation members 35*a* and 35*b* can move in the width direction. The side end cutout portions 32*b* and 32*c* form a space large enough for the side end regulation members to move in the width direction to a position capable of regulating the side ends of a minimum size (such as A5 size) sheet. Here, the "minimum size" represent the smallest size among sheet sizes to be stored in the sheet feed cassette 30 without using a rear end regulation attachment 100.

The rear end regulation member 36 is supported to slide on the bottom portion 30*b* along a groove-like guide portion 151 formed as a long cutout in the sheet feed direction (direction of arrow D) on the bottom portion 30*b* of the cassette body 30*a*. The sheet stacking portion 32 has a rear end cutout portion 152 formed in the same direction as the guide portion 151 so that the sheet stacking portion 32 does not interfere with the movement of the rear end regulation member 36 when the rear end regulation member 36 is slid.

In other words, the rear end regulation member 36 is guided by the guide portion 151 to be able to move in the sheet feed direction and a direction opposite thereto (opposite direction). The rear end cutout portion 152 forms a space allowing the rear end regulation member 36 to move in the sheet feed direction and the opposite direction, that is to say, forms a space in which the rear end regulation member 36 can move in the sheet feed direction and the opposite direction. The rear end regulation member 36 includes a main regulating surface 36*a* described later, which abuts against a rear end (upstream end) of the sheets P in the sheet feed direction stacked on the sheet stacking portion 32, regulating the rear end position of the sheets P.

According to the present embodiment, the sheet stacking portion 32 is formed so that the area between the side end cutout portions 32*b* and 32*c* is relatively narrow in the width direction, and that the rear end cutout portion 152 is formed along the longitudinal direction of the narrow sheet stacking portion 32.

With the above arrangement, the side end regulation members 35*a* and 35*b* and the rear end regulation member 36 are capable of sliding within the cassette body 30*a*. Therefore, users set positions of above regulation members arbitrarily within the predetermined regulation range depending on the size of the sheet being used, so that the front end position of sheets having an arbitrary size can be constantly regulated to a predetermined position.

It is noted that the regulation range of a rear end of a sheet by the rear end regulation member 36 is set normally as the range for regulating frequently-used sheets. In the present embodiment, the minimum size of a sheet capable of being regulated by the rear end regulation member 36 is determined, for example, to an A5-size. As for sheets of smaller sizes (such as postcards and envelopes), they are not sufficiently regulated by the rear end regulation member 36. It is conceivable that the range of motion (movable range in the sheet feed direction) of the rear end regulation member 36 is widened so as to enable regulation of small-sized sheets such as postcards and envelopes. With this configuration, however, the rear end cutout portion 152 of the sheet stacking portion 32 needs to be widened. That may lead to deterioration of the rigidity of the sheet stacking portion 32.

When the rigidity of the sheet stacking portion 32 is deteriorated, there is fear that the sheet stacking portion 32 is deformed. That is to say, the sheet stacking portion 32 lifted by the lifter arm 34 may be deformed under the weight of sheets, which may be a large number of sheets, have a large size (such as A3 size), or have large basis weight (such as a cardboard). In other words, the sheet stacking portion 32 cannot appropriately retain the weight of large-sized sheets. In a case that the sheets have not been lifted to reach a feedable position, feeding failure of the sheets may occur.

The present embodiment solves the above-described problem by attaching the rear end regulation attachment 100 to the rear end regulation member 36 in order to regulate the rear end of small-sized sheets. The details of this arrangement will be described below.

Figure 4:
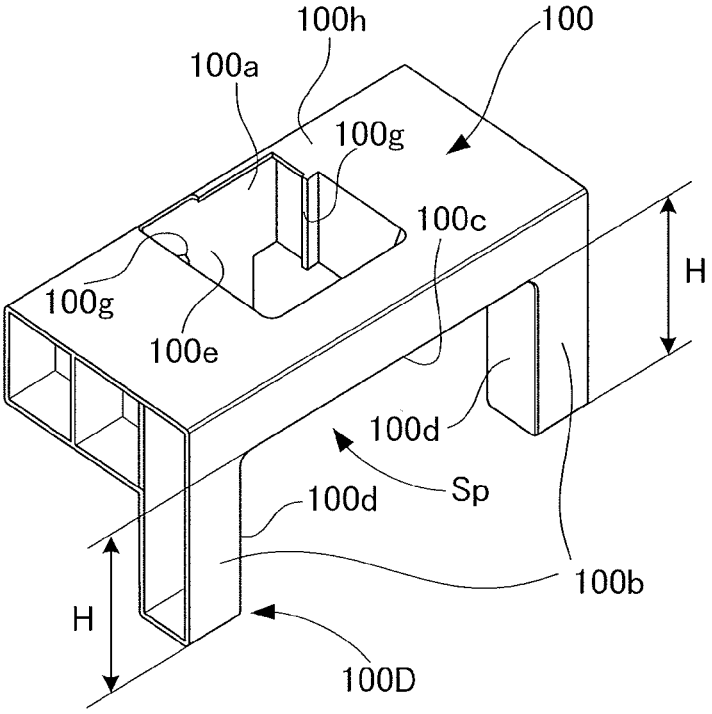
FIG. 4 is a perspective view illustrating a rear end regulation attachment according to the present embodiment.
Figure 5A:
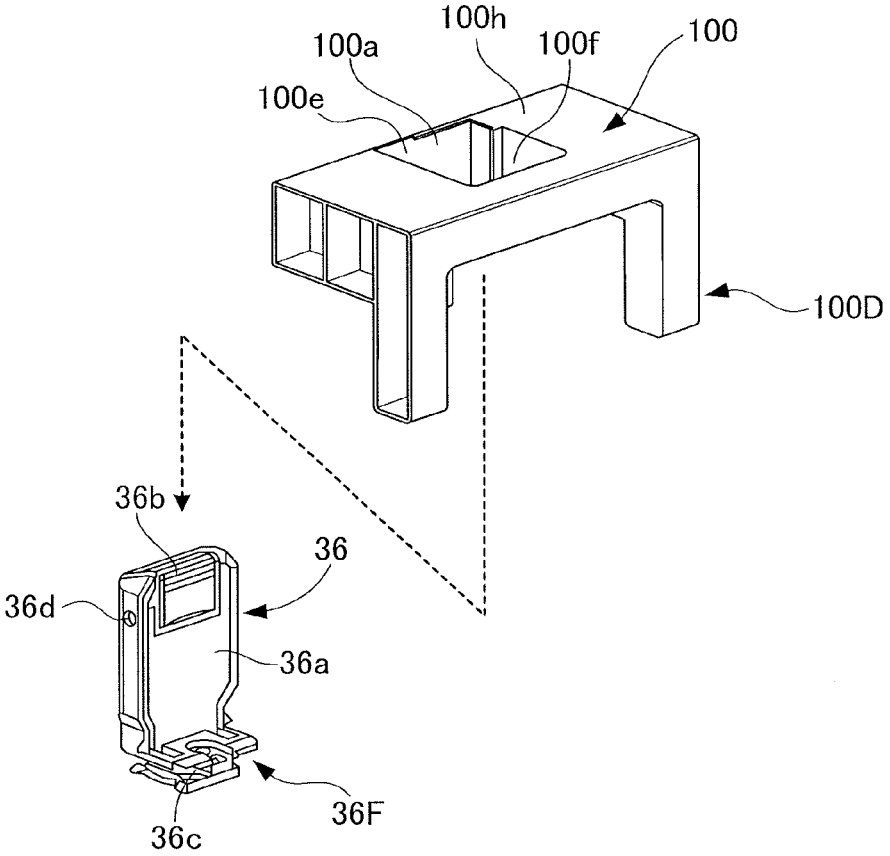
FIG. 5A is a perspective view illustrating a rear end regulation member and the rear end regulation attachment according to the present embodiment, in a state prior to attaching the rear end regulation attachment to the rear end regulation member according to the present embodiment.
Figure 5B:
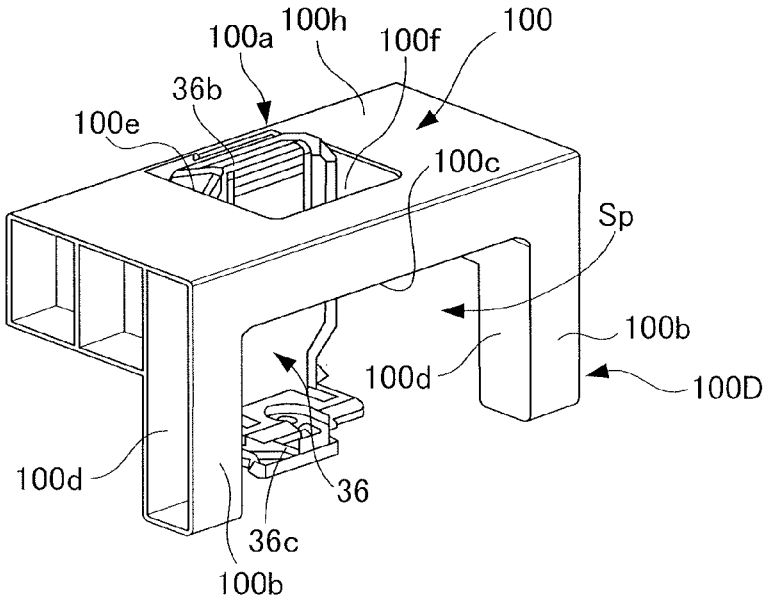
FIG. 5B is a perspective view illustrating a rear end regulation member and the rear end regulation attachment according to the present embodiment, in a state after attaching the rear end regulation attachment of FIG. 5A to the rear end regulation member.

Arrangement of the Rear End Regulation Member and the Rear End Regulation Attachment The arrangement of the rear end regulation member 36 on which the rear end regulation attachment 100 according to the present embodiment is attached will be described with reference to FIGS. 2A, 4, 5A and 5B. FIG. 4 is a perspective view illustrating the rear end regulation attachment 100 according to the present embodiment. FIG. 5A is a perspective view illustrating a rear end regulation member 36 and the rear end regulation attachment 100 in a state before the rear end regulation attachment 100 is attached to the rear end regulation member 36. FIG. 5B is a perspective view illustrating a rear end regulation member 36 and the rear end regulation attachment 100 in a state after the rear end regulation attachment 100 of FIG. 5A is attached to the rear end regulation member 36.

As shown in FIG. 2A and FIGS. 5A and 5B, the rear end regulation member 36 includes the main regulating surface 36*a* for regulating a rear end of the sheets P stacked on the sheet stacking portion 32, and a pinching portion (pinch portion) 36*b* capable of pivoting around a pivot shaft 36*d*. Further, the rear end regulation member 36 includes an engagement portion 36*c* capable of switching between an engaged state and a non-engaged state. By a pivoting (pinching) operation of the pinching portion 36*b*, the engagement portion 36*c* is engaged with and disengaged from a fine irregular portion 151*a* (rack portion) disposed along the guide portion 151. The engagement portion 36*c* includes engagement teeth (not shown) that engage with the irregular portion 151*a* based on the pivoting operation of the pinching portion 36*b*.

Therefore, the user can engage the engagement portion 36*c* to the irregular portion 151*a* by operating the pinching portion 36*b*, to thereby lock the rear end regulation member 36 to the cassette body 30*a*. Further, by separating the engagement portion 36*c* from the irregular portion 151*a*, the user can release the lock of the rear end regulation member 36 and move the rear end regulation member 36. The pinching portion 36*b*, the engagement portion 36*c* and the irregular portion 151*a* constitute a lock mechanism 36F (rear lock mechanism) for locking the rear end regulation member 36. A lock mechanism (side lock mechanism) for locking the side end regulation members 35*a* and 35*b*, which abut against the ends of the sheets, is also provided in the sheet storage apparatus. This lock mechanism fir the side end regulation members is arranged similarly as the lock mechanism of the rear end regulation member.

Figure 6A:
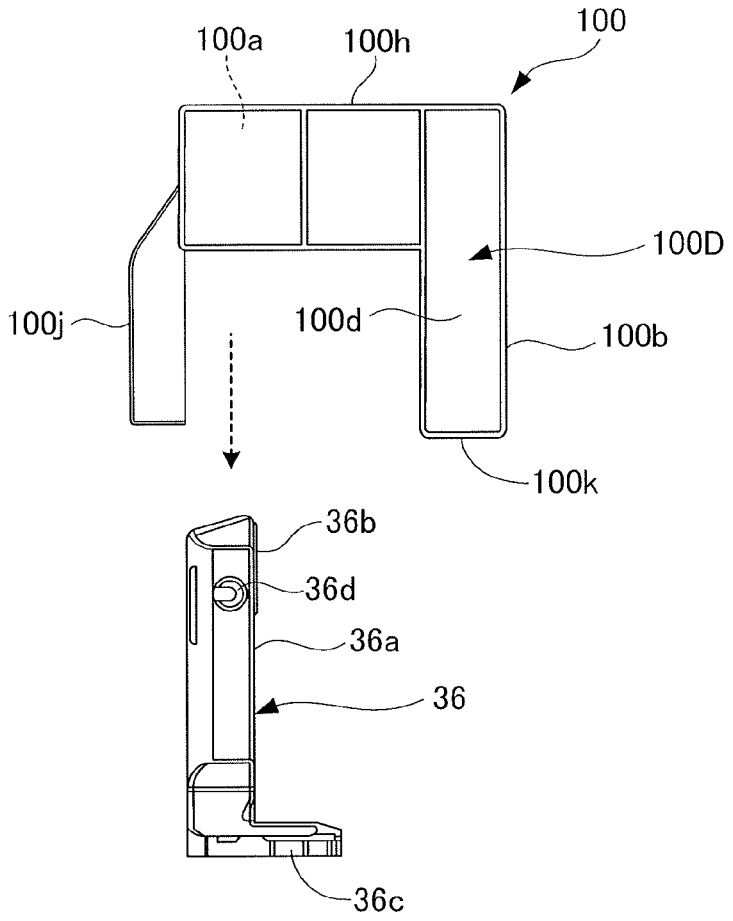
FIG. 6A is a side view illustrating the rear end regulation member and the rear end regulation attachment according to the present embodiment, in a state prior to attaching the rear end regulation attachment to the rear end regulation member.
Figure 6B:
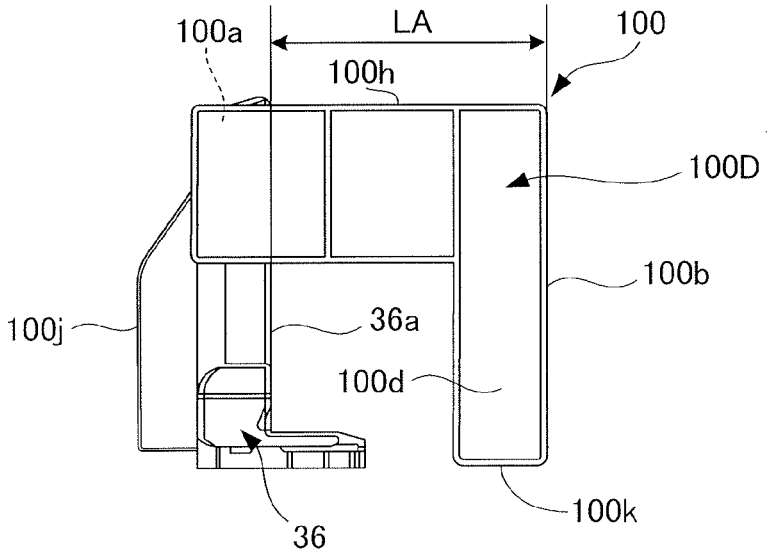
FIG. 6B is a side view illustrating the rear end regulation member and the rear end regulation attachment according to the present embodiment, in a state after attaching the rear end regulation attachment of FIG. 6A to the rear end regulation member.

Next, an arrangement of a rear end regulation attachment 100 will be described with reference to FIG. 4, FIGS. 5A and 5B and FIGS. 6A and 6B. FIGS. 6A and 6B are side views of the rear end regulation member and the rear end regulation attachment according to the present embodiment, FIG. 6A illustrating a state prior to attaching the rear end regulation attachment 100 to the rear end regulation member 36, and FIG. 6B illustrating a state where the rear end regulation attachment 100 of FIG. 6A is attached to the rear end regulation member 36.

As illustrated in FIGS. 5A and 5B, the rear end regulation attachment 100 includes a base 100*h*, and a regulating portion 100D. The regulating portion 100D is an example of a regulating portion and composed of a pair of leg portions 100*d* and 100*d* (first regulating portion and second regulating portion). The base 100*h* has a mounting portion 100*a* in which a substantially rectangular mounting hole is formed. The mounting hole is configured to be engaged with (fit to) the rear end regulation member 36 from above, in attaching the attachment. The shape of the mounting hole is not restricted to a rectangle and applicable with other shapes such as a semicircle and a triangle. Such a mounting hole should be shaped as the mounting portion 100*a* fit to (is attachable to) the rear end regulation member 36, and is configured preferably to reserve an operation space 100*f* described later. In the state where the mounting portion 100*a* of the rear end regulation attachment 100 is attached to the rear end regulation member 36, the rear end regulation attachment 100 moves integrally with the rear end regulation member 36.

As illustrated in FIGS. 6A and 6B, the base 100*h* extends from the mounting portion 100*a* toward the sheet feed direction (right side in the drawing), and supports the regulating portion 100D at a downstream end in the sheet feed direction. Therefore, in the state where the rear end regulation attachment 100 is attached to the rear end regulation member 36, the leg portions 100*d* and 100*d* are arranged downstream in the sheet feed direction than the main regulating surface 36*a* of the rear end regulation member 36. The leg portions 100*d* and 100*d* of the rear end regulation attachment 100 in an attached state, extend downward via a cutout (opening) formed by the side end cutout portions 32*b* and 32*c*, and abuts against an upper surface of the bottom portion 30*b* of the cassette body 30*a* at lower end portions 100*k* and 100*k*.

According to the present embodiment, the side end cutout portions 32*b* and 32*c* are utilized as openings formed through the sheet stacking portion 32 for arranging the regulating portion 100D. It is also possible to provide an opening that opens in the upward and downward direction separately from the side end cutout portions 32*b* and 32*c*, and have the regulating portion 100D arranged therein. In that case, similar to the side end cutout portion according to the present embodiment, it is preferable that the opening is formed to at least extend in the sheet feed direction so as to allow movement of the rear end regulation attachment 100 to the sheet feed direction and the direction opposite thereto. Further, the number of leg portions constituting the regulating portion 100D can be one, or more than three, depending on the arrangement of the apparatus.

The leg portions 100*d* and 100*d* respectively have subsidiary regulating surfaces 100*b* and 100*b* at side surfaces, downstream in the sheet feed direction, for regulating a rear end of small-sized sheets stacked on the sheet stacking portion 32. In other words, the regulating portion 100D has subsidiary regulating surfaces 100*b* and 100*b* arranged downstream in the sheet feed direction from the main regulating surface 36*a* in a state where the regulating portion is attached to the rear end regulation member 36. That is, with the subsidiary regulating surfaces 100*b* and 100*b*, the rear end regulation attachment 100 is capable of regulating the rear end (upstream end in the sheet feed direction) of a small-sized sheet, which has a shorter length in the sheet feed direction than the sheets being regulated by the main regulating surface 3*a* of the rear end regulation member 36 that is moved to the most downstream side. The subsidiary regulating surfaces 100*b* and 100*b* do not have to be disposed integrally with the leg portions 100*d* and 100*d*, and can be disposed separately from the leg portions 100*d* and 100*d*.

Further, as illustrated in FIG. 6A, the rear end regulation attachment 100, which is attached to the rear end regulation member 36, includes a support portion 100*j* extended in the vertical direction on the upstream in the sheet feed direction. The support portion 100*j* guides the rear end regulation attachment 100 to move along a rear end portion (back portion) of the rear end regulation member 36 when the rear end regulation attachment 100 illustrated in FIG. 6A is lowered from above to fit the mounting portion 100*a* to the rear end regulation member 36. The support portion 100*j* is formed shorter than the leg portions 100*d* and 100*d* in the vertical direction.

As shown in FIGS. 5A and 5B, the size of the mounting hole formed in the mounting portion 100*a* is set greater than the size of the rear end regulation member 36 viewed from above. The rear end regulation attachment 100 being attached to the rear end regulation member 36 is at a biased position toward the upstream side (rear side) in the sheet feed direction. With this configuration, an operation space 100*f* is formed on the downstream side (front side) in the sheet feeding direction of the mounting hole, allowing the pinching portion 36*b* positioned on the inner side of the mounting hole to be pinched by fingers. As shown in FIG.

5A, the rear end regulation attachment 100 includes a support surface 100*e* supporting the both side surfaces and rear surface of the rear end regulation member 36 fit to the mounting hole of the mounting portion 100*a*. On the outer side of the support surface 100*e* is positioned the support portion 100*j* illustrated in FIGS. 6A and 6B, which is arranged to face on the rear surface of the rear end regulation member 36 illustrated in FIG. 4.

As shown in FIGS. 4 and 5, locking projections 100*g* are formed on the mounting portion 100*a* protruding from both width-direction sides to the inner side of the mounting hole in the mounting portion 100*a*, and extending in the vertical direction between the support surface 100*e* and the operation space 100*f*.

The rear end regulation member 36 is engaged to the rear side of the mounting hole formed in the mounting portion 100*a*. The rear surface and both side surfaces of the rear end regulation member 36 are supported by the support surface 100*e* as illustrated in FIG. 5B, while both side surfaces being pressed to hold by the locking projections 100*g*. Therefore, in regulating the rear end of the sheet S by the subsidiary regulating surface 100*b*, the rear end regulation attachment 100 is prevented from being displaced with respect to the rear end regulation member 36.

On the base 100*h* of the rear end regulation attachment 100 is disposed a connecting portion 100*c* positioned between leg portions 100*d* and 100*d*, which are arranged at different positions in the width direction. The connecting portion 100*c* connects the upper portion of the leg portions 100*d* and 100*d*. The connecting portion 100*c* is positioned above the sheet stacking portion 32 that is so lifted that the pickup roller 62 abuts against an uppermost sheet of the sheets stacked on the sheet stacking portion 32 (refer to FIG. 10B). Therefore, the area surrounded by the leg portions 100*d* and 100*d* and the connecting portion 100*c* constitute a movement space Sp in which the sheet stacking portion 32 can be lifted.

Accordingly, as illustrated in FIG. 4, the height from the lower ends of the leg portions 100*d* and 100*d* to the connecting portion 100*c* is set a height dimension H. As illustrated in FIG. 5B, the height dimension H is such a height that the connecting portion 100*c* attached to the rear end regulation member 36 does not interfere with the lifting operation of the sheet stacking portion 32, which is lifted to a predetermined feeding position (refer to FIG. 10B).

As illustrated in FIG. 5B, the side surface of the base 100*h* downstream in the sheet feed direction is arranged at a same position as the subsidiary regulating surface 100*b* of the leg portion 100*d* in the sheet feed direction, and is formed continuously with the subsidiary regulating surface 100*b*. Therefore, the base 100*h* together with the leg portion 100*d* (regulating portion 100D) constitutes a portion of the regulating surface capable of abutting against a rear end of the sheets P stacked on the sheet stacking portion 32.

Figure 9A:
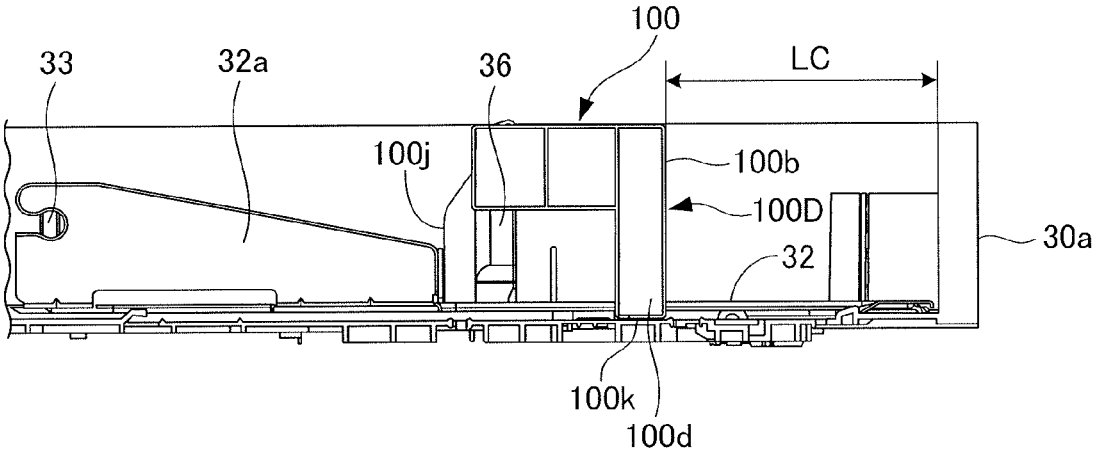
FIG. 9A is a side view of the sheet feed cassette according to the present embodiment, in a state where the rear end regulation member to which the rear end regulation attachment is attached is moved forward.
Figure 9B:
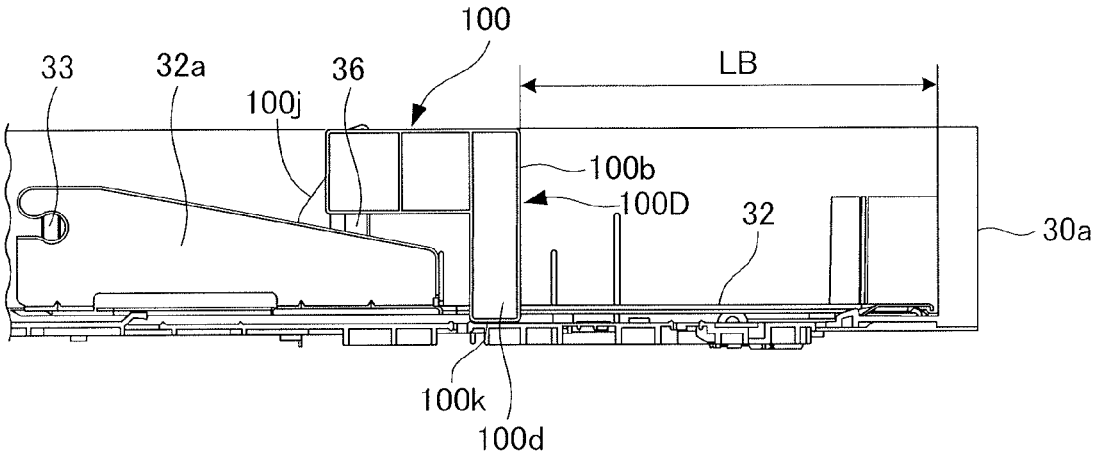
FIG. 9B is a side view of the sheet feed cassette according to the present embodiment, in a state where the rear end regulation member to which the rear end regulation attachment is attached is moved backward.

While the above-described rear end regulation attachment 100 is attached to the rear end regulation member 36, which is projected upward through the rear end cutout portion 152, the pair of the leg portions 100*d* and 100*d* abut against the bottom portion 30*b* in a lower end portion 100*k* in such a manner that the pair of the leg portions 100*d* straddle the sheet stacking portion 32 (refer to FIGS. 9A and 9B). That is, the rear end regulation attachment 100 attached to the rear end regulation member 36 is supported in three places, the mounting portion 100*a* and the lower end portions 100*k* of the leg portions 100*d*, respectively on the rear end regulation member 36 and the bottom portion 30*b* of the cassette body 30*a*. Thereby, the rear end regulation attachment 100 is moved stably together with the rear end regulation member 36 while sliding the lower end portion against the upper surface of the bottom portion 30*b* of the cassette body 30*a*.

When the rear end regulation attachment 100 is attached to the rear end regulation member 36, as illustrated in FIGS. 6A and 6B, the subsidiary regulating surface 100*b* is arranged at a position downstream of the main regulating surface 36*a* by a predetermined length LA.

Figure 7:
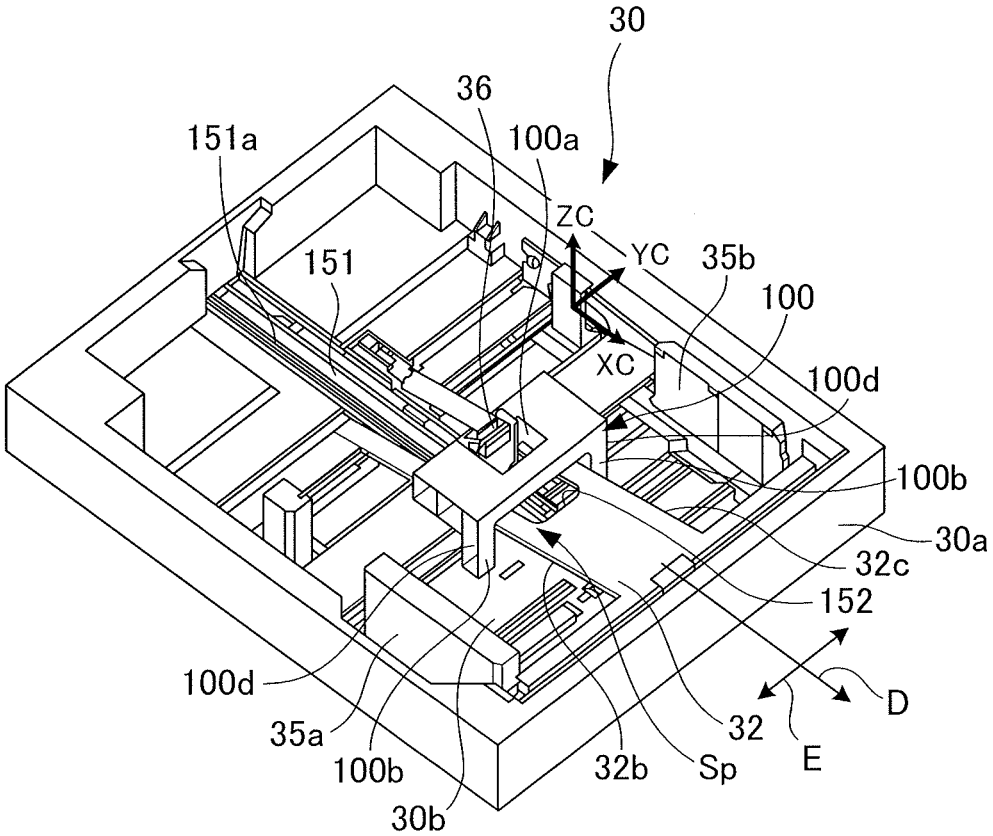
FIG. 7 is a perspective view of the sheet feed cassette according to the present embodiment, in a state where the rear end regulation attachment is attached to the rear end regulation member.
Figure 8A:
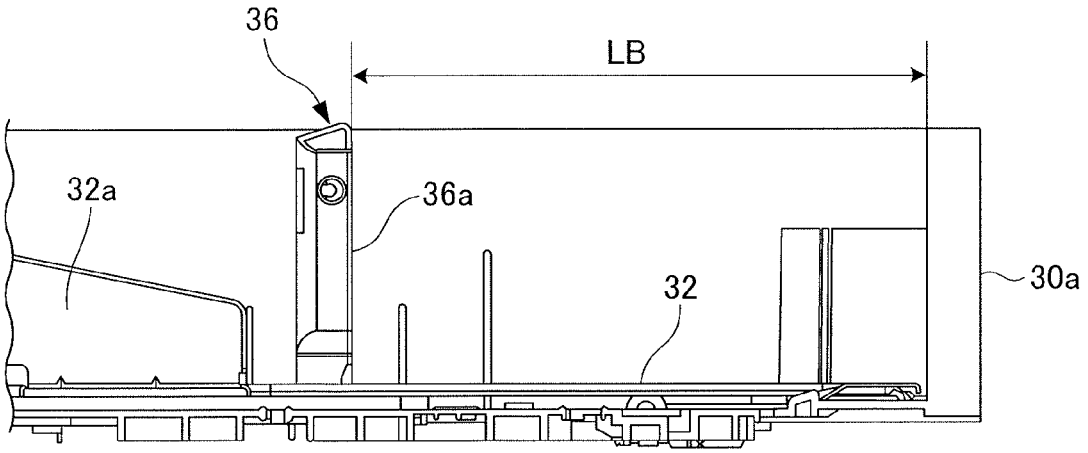
FIG. 8A is a side view of the sheet feed cassette according to the present embodiment, in a state where the rear end regulation member from which the rear end regulation attachment is detached is moved to a minimum regulating position.
Figure 8B:
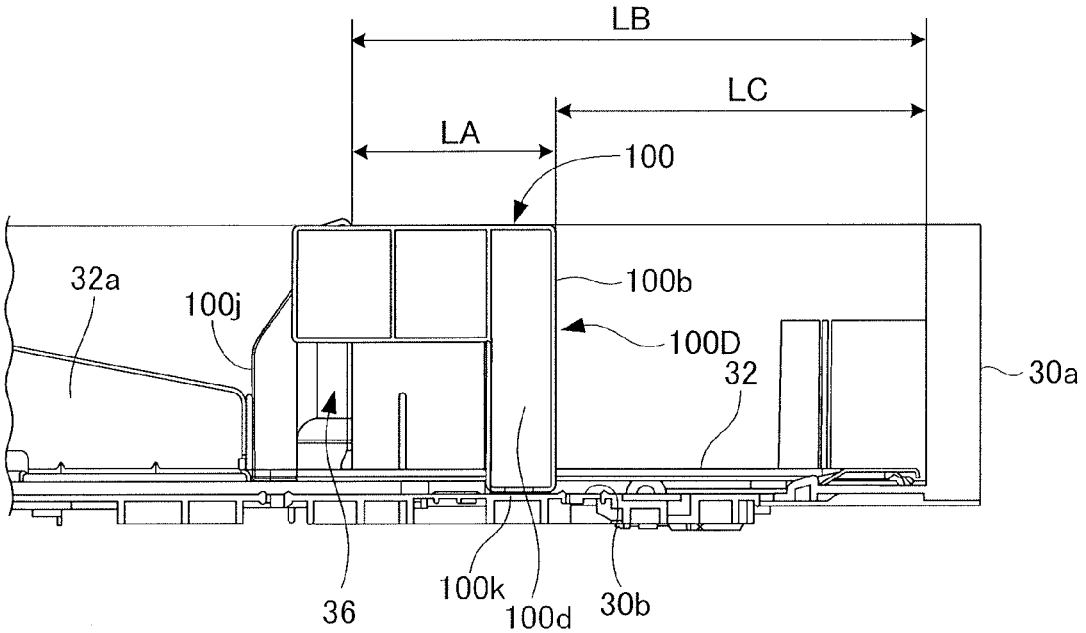
FIG. 8B is a side view of the sheet feed cassette according to the present embodiment, in a state where the rear end regulation member to which the rear end regulation attachment is attached is moved to the minimum regulating position.

Next, the details of the sheet feed cassette 30 with the rear end regulation attachment 100 being attached to the rear end regulation member 36 will be described with reference to FIGS. 7, 8A and 8B. FIG. 7 is a perspective view of the sheet feed cassette according to the present embodiment, with the rear end regulation attachment 100 attached to the rear end regulation member 36. FIG. 8A illustrates a side view of the sheet feed cassette with the rear end regulation member 36 being detached the rear end regulation attachment 100 from and moved to a minimum regulating position (regulating position at the downstream end). FIG. 8B is a side view of the sheet feed cassette with the rear end regulation attachment 100 being attached to the rear end regulation member 36 and positioned at the minimum regulating position.

As described above with reference to FIG. 6, the subsidiary regulating surface 100*b* of the rear end regulation attachment 100 that is attached to the rear end regulation member 36 is positioned downstream in the sheet feed direction by the length LA from the main regulating surface 36*a* of the rear end regulation member 36 before attachment. Therefore, as illustrated in FIG. 8B, the minimum regulating dimension LC with the attachment is shorter by length LA than the minimum regulating dimension LB, the lower limit of the regulation range of the rear end regulation member 36 without the attachment (illustrated in FIG. 8A). Thereby, according to the present embodiment, it becomes possible to regulate the rear end of sheets of a minimum regulating dimension LC in length, which is shorter than the minimum regulating dimension LB under the configuration illustrated in FIG. 8A, where the sheets are regulated by the rear end regulation member 36, by length LA.

Now, it will be described with reference to FIGS. 9A and 9B that the rear end regulation attachment 100 attached to the rear end regulation member 36 moves along with the movement of the rear end regulation member 36. FIG. 9A is a side view of the sheet feed cassette 30, of which the rear end regulation member 36 with the rear end regulation attachment 100 is moved forward. FIG. 9B is a side view of the sheet feed cassette 30, of which the rear end regulation member 36 with the rear end regulation attachment 100 is moved backward.

As illustrated in FIGS. 9A and 9B, the rear end regulation attachment 100, being attached to the rear end regulation member 36, moves backward together with the rear end regulation member 36. When the rear end regulation member 36 is moved to the backward end, the rear end regulation attachment 100 is at such a position that allows the apparatus to storage the sheets of or shorter than the minimum regulating dimension LB in length (See FIG. 9B). With this configuration, the sheet storage feed 30 is applicable for a sheet having an arbitrary dimension between the minimum regulating dimension LB, the minimum size in regulating with the rear end regulation member 36, and the minimum regulating dimension LC, the minimum size in regulating with the rear end regulation attachment 100 attached to the rear end regulation member 36. That is, by moving the rear end regulation member 36, the rear end of such a sheet is sufficiently regulated by the rear end regulation attachment 100.

Figure 10A:
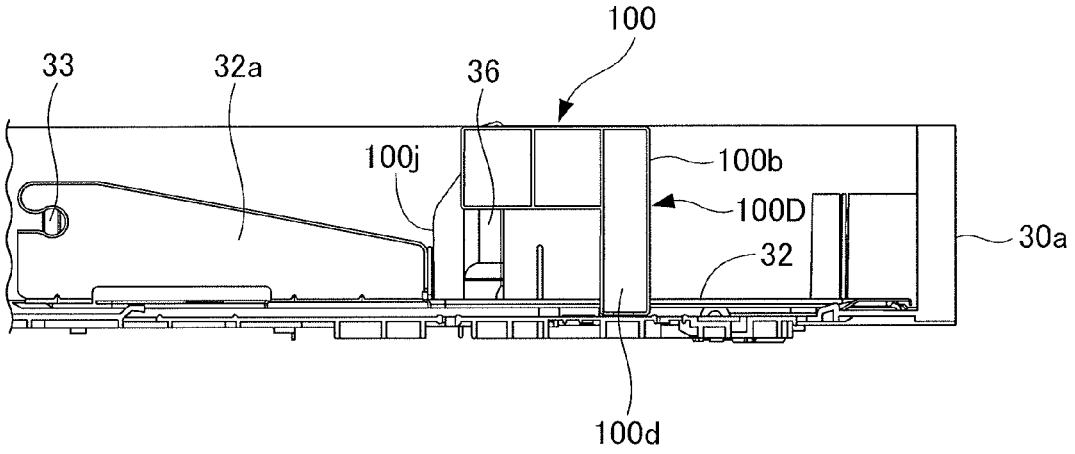
FIG. 10A is a side view of the sheet feed cassette according to the present embodiment, in a state where the rear end regulation attachment is attached to the rear end regulation member and a sheet stacking portion is positioned at a lower position.
Figure 10B:
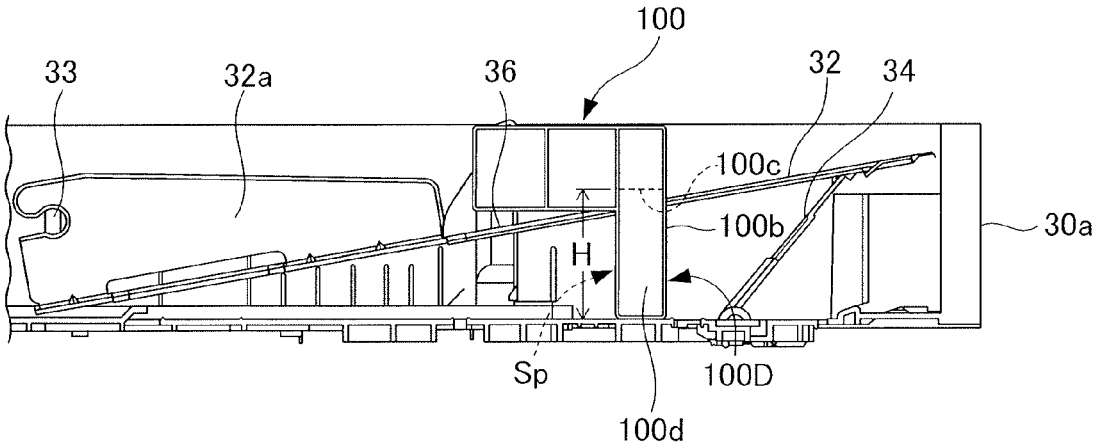
FIG. 10B is a side view of the sheet feed cassette according to the present embodiment, in the state where the sheet stacking portion is lifted from the lower position illustrated in FIG. 10A.

Now, lifting operation of the sheet stacking portion 32 will be described with reference to FIGS. 7, 10A, and 10B, which is performed after the rear end regulation attachment 100 is attached to the rear end regulation member 36. FIG. 10A is a side view of the sheet feed cassette 30 of which the sheet stacking portion 32 is not lifted yet, with the rear end regulation attachment 100 being attached to the rear end regulation member 36. FIG. 10B is a side view of the sheet feed cassette 30 of which the sheet stacking portion 32 is lifted from the position illustrated in FIG. 10A.

As illustrated in FIG. 7, in a state where the rear end regulation attachment 100 is attached to the rear end regulation member 36, the sheet stacking portion 32 is positioned within the movement space Sp between the pair of subsidiary regulating surfaces 100*b* and 100*b* aligned in the width direction. Thereby, the rear end regulation attachment 100 is stably abutted, in a slidable manner, on the upper surface of the bottom portion 30*b* of the cassette body 30*a* in the sheet feed cassette 30, instead of on the sheet stacking portion 32.

Now, some operations for loading sheets P into the sheet feed cassette 30 will be described. At first, if the sheet size is equal to or greater than a minimum size (such as A5 size) that can be regulated by the rear end regulation member 36, the user places the sheets on the sheet stacking portion 32 while keeping the side end regulation members 35*a* and 35*b* and the rear end regulation member 36 on an outer-wall side of the cassette body 30*a*. Then, the user moves the side end regulation members 35*a* and 35*b* and the rear end regulation member 36 to a position corresponding to the side end positions and the rear end position of the sheets. In another example, the user moves the side end regulation members 35*a* and 35*b* and the rear end regulation member 36 in advance to a position corresponding to the size of the sheets to be loaded, and to place the sheets from above onto the sheet stacking portion 32. In this manner sheets having a size equal to or greater than the minimum sheet size (such as A5 size) are loaded into the sheet feed cassette 30 and regulated position thereof.

On the other hand, the user attaches the rear end regulation attachment 100 to the rear end regulation member 36 in loading small-sized sheets, which are smaller than the minimum size capable of being regulated by the rear end regulation member 36 (such as postcards and envelopes), to the sheet feed cassette 30. Then, the user places the small-sized sheets to the sheet stacking portion 32, and moves the side end regulation members 35*a* and 35*b* and the rear end regulation member 36. The user regulates the ends in the width direction of the sheets by the side end regulation members 35*a* and 35*b*, while regulating the rear ends of the sheets with the rear end regulation attachment 100 attached to the rear end regulation member 36. In this manner, small-sized sheets, which are smaller than the minimum size sheet (such as A5 size), are loaded into the sheet feed cassette 30 and sufficiently regulated position thereof. It is noted that various types of small-sized sheets having different dimensions in the sheet feed direction and/or the width direction may be loaded. Thus, the user moves the side end regulation members 35*a* and 35*b* and the rear end regulation member 36 to abut against the ends of stacked sheets depending on the dimension of the sheets, so as to regulate the side ends and the rear end of the sheet among the various types of sheets.

By the way, it is a conceivable arrangement that the rear end regulation attachment 100 is supported by the sheet stacking portion 32, by placing the rear end regulation attachment 100 on the sheet stacking portion 32, for example. But such an arrangement may lead to inconvenience as following. When the sheet stacking portion 32 is pivoted around a fulcrum of the support shaft 33 in moving the uppermost surface of the sheet to a feedable position for the pickup roller 62 (refer to FIG. 1), the rear end regulation attachment 100 is lifted up along with the pivoting of the sheet stacking portion 32. Lifting of the rear end regulation attachment 100 along with the lifting of the sheet stacking portion 32 necessitates increase in size of the apparatus body 1*a* because of preventing interference between the upper surface of the rear end regulation attachment 100 and the apparatus body 1*a* resulting in increase in size of the printer 1.

In contrast, according to the present embodiment, as illustrated in FIG. 10A, the rear end regulation attachment 100 is supported on the bottom portion 30*b* of the sheet feed cassette 30, instead of on the sheet stacking portion 32. Furthermore, as illustrated in FIG. 10B, the sheet stacking portion 32 being lifted moves within the movement space Sp formed by the rear end regulation attachment 100. With this configuration, moving of the sheet stacking portion 32 is not interfered with the rear end regulation attachment 100 that is assembled into the sheet feed cassette 30. Thereby, pivoting of the sheet stacking portion 32 is enabled without increase in size of the apparatus. It is noted that the height dimension H of the rear end regulation attachment 100 is set to such a height that the attachment does not interfere with the sheet stacking portion 32 lifted to a predetermined sheet feeding position. Therefore, lifting of the rear end regulation attachment 100 along with the pivoting of the sheet stacking portion 32 as mentioned above does not occur.

As descried above, according to the present embodiment, small-sized sheets such as postcards and envelopes are fed with the rear end regulation attachment 100 that is easily attached to and removed from the rear end regulation member 36. Since it is not required to widen the area of cutout of the rear end cutout portion 152, regulation of the rear end of small-sized sheets is carried out appropriately without deteriorating the rigidity of the sheet stacking portion 32. With this configuration, the sheet feed cassette 30 stores a large amount of small-sized sheets so that the sheets are fed stably therefrom.

Further, the rear end regulation attachment 100 slides together with the rear end regulation member 36 within the sheet feed cassette 30, Thereby, a variety of sheets different in size are inclusively and stably regulated with the rear end regulation attachment 100. This arrangement eliminates the need for troublesome operations required in conventional arts, such as replacing attachments every time the sheet size is changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-002108, filed on Jan. 8, 2015, and 2015-239301, filed on Dec. 8, 2015, which are hereby incorporated by reference herein in their entirety.

What is claimed is:

1. A sheet storage apparatus comprising:

a storage apparatus body;

a sheet stacking portion on which a sheet is stacked, the sheet stacking portion configured to be movable upward and downward with respect to a bottom portion of the storage apparatus body, the sheet stacking portion having an opening opened in an upward and downward direction;

a rear end regulation member supported movably on the bottom portion in a sheet feed direction and a direction opposite to the sheet feed direction, the rear end regulation member configured to regulate a position of an upstream end, in the sheet feed direction, of the sheet stacked on the sheet stacking portion;

a side end regulation member configured to regulate an end position, in a width direction orthogonal to the sheet feed direction, of the sheet stacked on the sheet stacking portion, the side end regulation member being movable in the width direction within a space formed by the opening; and a rear end regulation attachment being detachably attached to the rear end regulation member, the rear end regulation attachment comprising a regulating portion extending toward the bottom portion of the storage apparatus body through the opening in a state where the rear end regulation attachment is attached to the rear end regulation member, and regulating the upstream end of the sheet on a position downstream, in the sheet feed direction, of a regulating position of the rear end regulation member.

2. The sheet storage apparatus according to claim 1, wherein a rear end cutout portion is formed with the sheet stacking portion, the rear end cutout portion forming a space in which the rear end regulation member moves in the sheet feed direction and the opposite direction.

3. The sheet storage apparatus according to claim 1, further comprising a guide portion disposed on the bottom portion of the storage apparatus body and guiding the rear end regulation member to the sheet feed direction and the opposite direction, wherein the opening of the sheet stacking portion extends at least in the sheet feed direction such that the rear end regulation attachment is capable of moving in the sheet feed direction while being in contact with the bottom portion, with a movement of the rear end regulation member along the guide portion.

4. The sheet storage apparatus according to claim 1, wherein the rear end regulation attachment comprises a base configured for engaging with the rear end regulation member, and the base engaged with the rear end regulation member extends downstream in the sheet feeding direction from the rear end regulation member, and supports the regulating portion with a downstream end portion of the base.

5. The sheet storage apparatus according to claim 4, wherein the regulating portion comprises a first regulating portion and a second regulating portion arranged at different positions from each other in the width direction orthogonal to the sheet feed direction, the base connects with the first regulating portion and the second regulating portion at positions above the sheet stacking portion, and the first regulating portion, the second regulating portion, and the base constitutes a regulating surface against which the upstream end of the sheet stacked on the sheet stacking portion abuts.

6. The sheet storage apparatus according to claim 4, further comprising a sheet feeding member disposed above the sheet stacking portion and feeding an uppermost sheet, which abuts against the sheet feeding member, of the sheets stacked on the sheet stacking portion being lifted, wherein a position of the base of the rear end regulation attachment is higher than a position of the sheet stacking portion upon the sheet feeding member abutting against the uppermost sheet.

7. The sheet storage apparatus according to claim 1, further comprising a lock mechanism configured to lock the rear end regulation member at positions corresponding to respective sizes of the sheets different in size.

8. The sheet storage apparatus according to claim 7, wherein the lock mechanism comprising a pinch portion to be pinched for releasing lock of the rear end regulation member, and the rear end regulation attachment is attached to the rear end regulation member such that an operation space for operating the pinch portion is formed between the rear end regulation attachment and the rear end regulation member.

9. An image forming apparatus comprising:

the sheet storage apparatus according to claim 1; and an image forming unit forming an image on a sheet conveyed from the sheet storage apparatus.

10. A sheet storage apparatus comprising:

a storage apparatus body;

a sheet stacking portion, on which a sheet is stacked, configured to be movable upward and downward with respect to a bottom portion of the storage apparatus body;

a side end regulation member supported movably on the bottom portion in a width direction orthogonal to a sheet feed direction, and abutting against an end portion in the width direction orthogonal to a sheet feed direction of the sheet stacked on the sheet stacking portion;

a rear end regulation member supported movably on the bottom portion in a sheet feed direction and a direction opposite to the sheet feed direction, and comprising a main regulating surface abutting against an upstream end in the sheet feed direction of the sheet stacked on the sheet stacking portion; and a rear end regulation attachment detachably attached to the rear end regulation member and comprising a subsidiary regulating surface, the subsidiary regulating surface arranged downstream, in the sheet feed direction, of the main regulating surface and configured to regulate the upstream end of the sheet, wherein the sheet stacking portion has a side end cutout portion for allowing movement of the side end regulation member and a rear end cutout portion for allowing movement of the rear end regulation member, and wherein the rear end regulation attachment is attached to the rear end regulation member in a condition in which the rear end regulation attachment slidably contacts with the bottom portion of the storage apparatus body through the side end cutout portion.

11. The sheet storage apparatus according to claim 10, wherein the rear end regulation attachment comprises an attaching portion for attaching the rear end regulation attachment to the rear end regulation member and a leg portion being slidably in contact with the bottom portion of the storage apparatus body, and forms a movement space allowing lifting of the sheet stacking portion in a state where the rear end regulation attachment is attached to the rear end regulation member.

12. The sheet storage apparatus according to claim 11, wherein the leg portion of the rear end regulation attachment constitutes at least a part of the subsidiary regulating surface.

13. The sheet storage apparatus according to claim 10, further comprising a rear lock mechanism configured to lock the rear end regulation member.

14. A sheet storage apparatus comprising:

a storage apparatus body;

a sheet stacking portion, on which a sheet is stacked, configured to be movable upward and downward with respect to a bottom portion of the storage apparatus body;

a rear end regulation member supported movably on the bottom portion in a sheet feed direction and a direction opposite to the sheet feed direction, the rear end regulation member being configured to regulate a position of an upstream end, in the sheet feed direction, of the sheet stacked on the sheet stacking portion;

a side end regulation member supported movably on the bottom portion in a width direction orthogonal to a sheet feed direction, the side end regulation member being configured to regulate an end position in the width direction orthogonal to a sheet feed direction of the sheet stacked on the sheet stacking portion; and a rear end regulation attachment detachably attached to the rear end regulation member and comprising a regulating portion configured to regulate the upstream end of the sheet on a position downstream, in the sheet feed direction, of a regulating position of the rear end regulation member in a state where the rear end regulation attachment is attached to the rear end regulation member, wherein, when viewed from above, in a state where the rear end regulation member with the rear end regulation attachment on is positioned at the most downstream position in the sheet feed direction, the regulating portion of the rear end regulation attachment is located at a position overlapping a space in which the side end regulation member is movable in the width direction orthogonal to a sheet feed direction in a state where the rear end regulation attachment is detached from the rear end regulation member.

15. The sheet storage apparatus according to claim 14, wherein the regulating portion comprises a first regulating portion and a second regulating portion arranged at different positions from each other in the width direction orthogonal to a sheet feed direction, the rear end regulation attachment comprises a base configured for engaging with the rear end regulating member, the base comprising a connecting portion connecting with the first and second regulating portions at positions above the sheet stacking portion, and the first regulating portion, the second regulating portion, and the connecting portion constitutes a regulating surface against which the upstream end of the sheet stacked on the sheet stacking portion abuts.

16. The sheet storage apparatus according to claim 14, wherein the regulating portion comprises a first regulating portion and a second regulating portion arranged at different positions each other in the width direction, and the rear end regulation attachment comprises a connecting portion connecting the first and second regulating portions, and wherein, in a state where the rear end regulation attachment is attached to the rear end regulation member, the stacking portion is movable upward and downward within a space defined by the first regulating portion, the second regulating portion, and the connecting portion.

* * * * *